United States Patent [19]

Tsuru et al.

[11] Patent Number: 4,651,803

[45] Date of Patent: Mar. 24, 1987

[54] BILLET CONTROL METHOD IN A HORIZONTAL CONTINUOUS CASTING SYSTEM

[75] Inventors: Masahiro Tsuru, Yokohama; Kazuto Mitani, Kawasaki, both of Japan

[73] Assignee: Nippon Kokan Kabushiki Kaisha, Tokyo, Japan

[21] Appl. No.: 768,747

[22] Filed: Aug. 23, 1985

[30] Foreign Application Priority Data

Sep. 5, 1984 [JP] Japan ..... 59-184446

[51] Int. Cl.[4] ..... B22D 11/20

[52] U.S. Cl. ..... 164/454; 164/490

[58] Field of Search ..... 164/454, 413, 490, 440, 164/478, 416

[56] References Cited

U.S. PATENT DOCUMENTS 3,669,176 6/1972 Krall et al. ..... 164/478

*Primary Examiner*—Kuang Y. Lin

*Attorney, Agent, or Firm*—Fleit, Jacobson, Cohn & Price

[57] ABSTRACT

A method for controlling the billet pushing back length for a horizontal continuous casting system is disclosed wherein, for allowing stable formation of the billet shell, the billet is pushed or forced back towards the mold during the transient stop or halt cycle of the intermittent billet extracting process. The pushing or forcing back pressure executed by the pinch rolls in controlled for each extracting cycle in order that the billet is pushed or forced back towards the mold a preset length.

7 Claims, 3 Drawing Figures

BILLET CONTROL METHOD IN A HORIZONTAL CONTINUOUS CASTING SYSTEM

BACKGROUND OF THE INVENTION

1. Field of the Invention

This invention relates to a billet control method in a horizontal continuous casting system. More particularly it relates to a method for controlling the length of pushing back of the billet towards the mold with the aid of the pinch rolls during the top cycle of the intermittent billet extraction process in order to promote stable growth of the newly formed billet shell.

2. Description of the Prior Art

In a conventional horizontal continuous casting system, billet extraction is by an intermittent process according to which the billet is drawn out of the mold at preset speed a preset length and halted for some time so as to allow for stable growth of the newly formed shell, the billet being again extracted after termination the growth of the shell. During the stop cycle, the billet is contracted in size, thus possibly causing rupture of the newly formed shell. In the conventional process, the following methods (a) or (b) are used so as not to obstruct free billet contraction between the pinch rolls and the mold. (a) The method of opening the pinch rolls apart during the stop cycle, according to which the pinch rolls are opened apart during the stop cycle to permit free contraction of the extracted billet between the pinch rolls and the mold so as to prevent cracking or rupture of the newly formed shell.

In the method (a), the previously formed shell and the newly formed shell are affixed to each other only slowly so that it is not possible to elevate the speed of the extraction cycle. In addition, the large-size billet tends to be ruptured on account of the higher frictional resistance between the billet and the rolls. Also, the extraction resistance in the mold is markedly changed with the mold profile, the temperature of the molten steel or the steel type, resulting in breakouts and obstruction of stable casting due to obstruction of free contraction of the billet and rupture of the newly formed shell. (b) The method of applying a reset pressure to the billet forcing back side of the driving hydraulic motor during the billet forcing back step. According to this method the billet forcing back step is provided in continuation to the stop cycle of the intermittent extraction process. During the billet forcing back step, a preset pressure is applied to the billet forcing back side of the pinch rolles driving hydraulic motor for pushing the billet back towards the mold for positively promoting billet contraction so as to prevent rupture of the newly formed shell. With the present method (b), however, the billet is forced back with a constant preset force despite fluctuations in the roll and/or mold resistances. The result is that occasionally the forcing back pressure is insufficient thus causing billet breakouts due to shell rupture, or the forcing back pressure becomes too strong thus again causing billet breakouts due to buckling of the newly formed shell.

With the above described conventional methods (a), (b) consisting in opening the pinch rolls apart or applying the preset pressure to the billet forcing back side of the driving hydraulic motor, it is not possible to successfully deal with fluctuations in the resistance inside the mold or the roll resistance, thus causing rupture or buckling of the newly formed shell and resulting breakouts.

SUMMARY OF THE INVENTION

The present invention has been made in order to obviate the above described deficiencies and to provide a method for controlling the billet forcing back length in the horizontal continuous casting system so as to provide for stable growth of the billet shell.

The control method of the present invention resides in that the forcing back pressure exerted by the pinch rolls is controlled on the cyclic basis in order that the billet being cast is forced back towards the mold a preset length at a preset location during the cycle time that the billet extraction is momentarily stopped.

In this manner, a pressure is exerted to the billet forcing back side of the pinch roll driving hydraulic motor in an amount corresponding to the preset length by which the billet is contracted. The billet is forced back by such forcing back pressure by a length corresponding to the billet contraction caused so as to prevent rupture of the newly formed shell, the pushing back length is measured by the extraction length measurement unit and compared with the command value and a plurality of unusual setting values in the control circuit. The result of the comparison is used for correcting the billet extraction speed or forcing back pressure for the next cycle for reducing the error caused by changes in the mold resistance or the mold resistance so as to be within a preset allowable range.

According to the present invention, it is unnecessary to take account of delicate changes in the resistance between the billet and the pinch rolls due to changes in billet size or the centering error. In addition, when it is found during a given cycle that the actual forcing back length is lesser than the command value or setting for the presently applied pressure, the pressure can be increased during the next cycle so that the forcing back length closer to the command value is reached. It is seen from above that present invention provides for stable growth of the newly formed shell and hence for stable horizontal continuous casting without rupture or buckling of the shell.

The objects and advantages of the present invention will become more apparent from the following detailed description of the present invention, especially when read in conjunction with the accompanying drawings.

DESCRIPTION OF A PREFERRED EMBODIMENT

Figure 1:
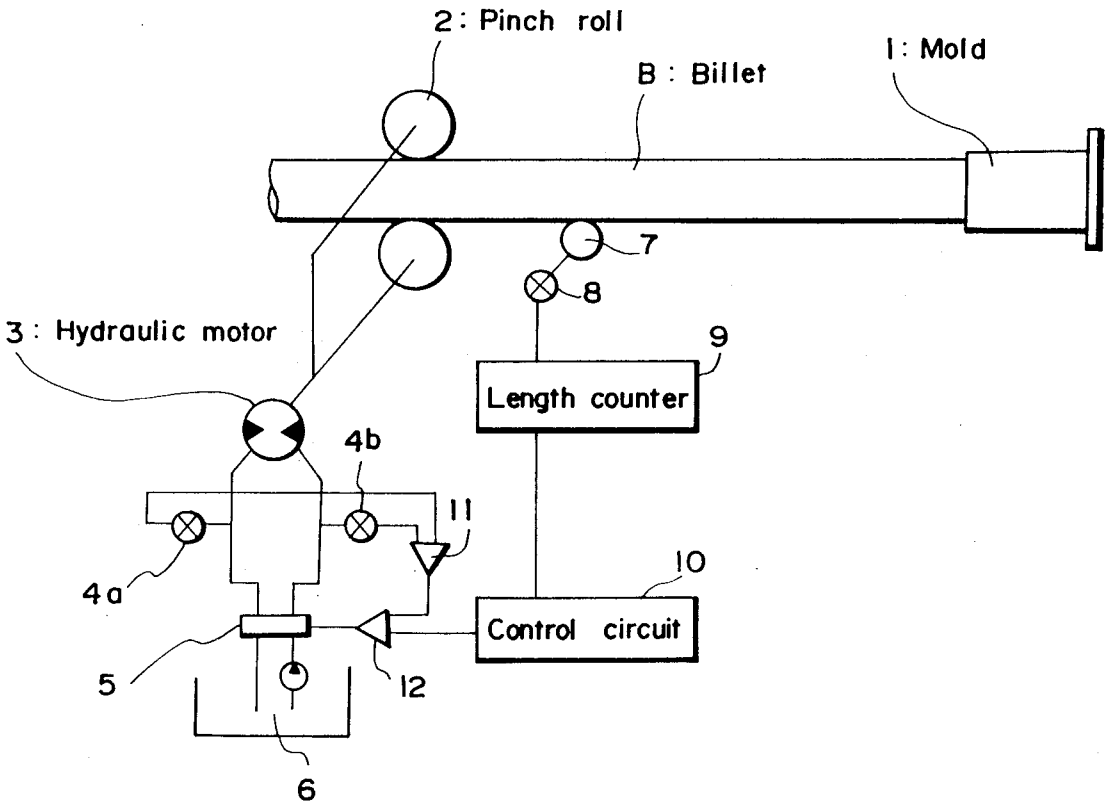
FIG. 1 is a schematic view showing the overall control system according to a preferred embodiment of the present invention.
Figure 2:
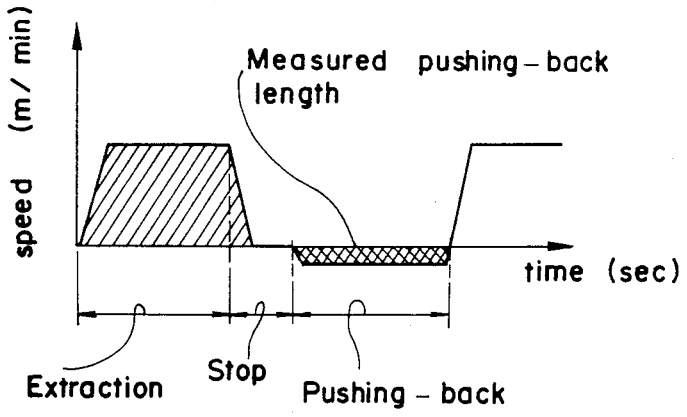
FIG. 2 is a chart showing the billet extraction process.
Figure 3:
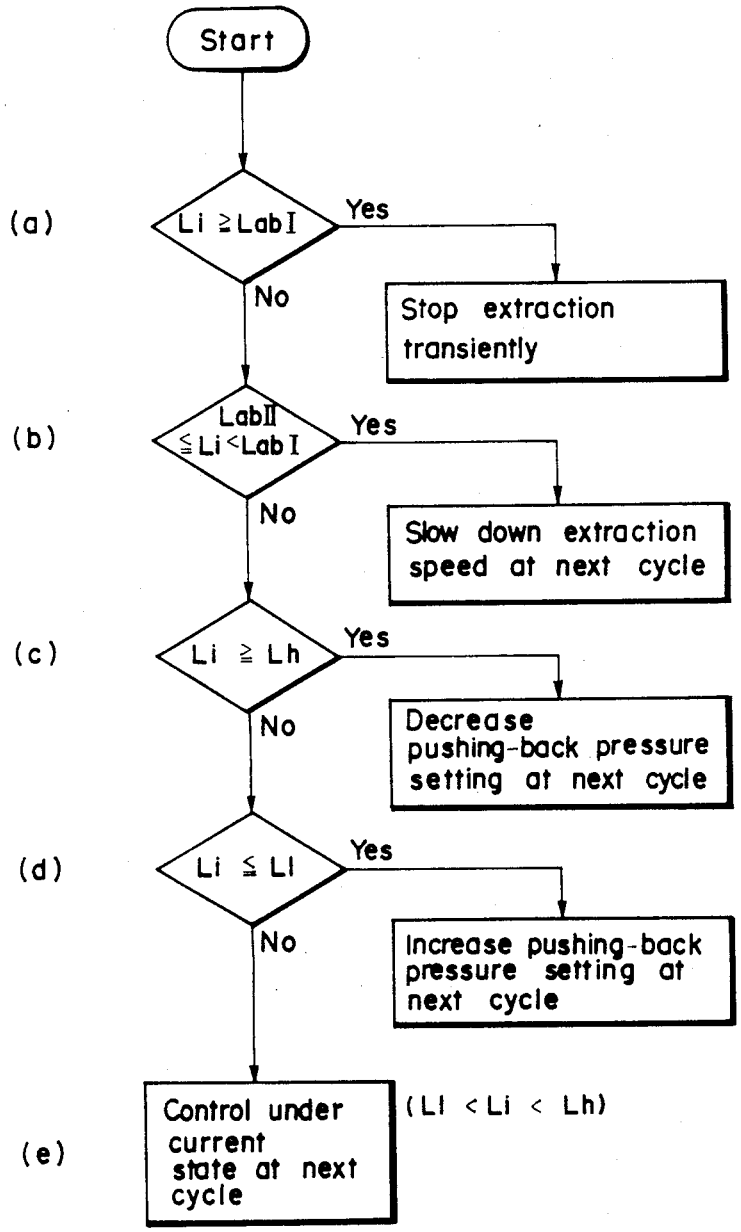
FIG. 3 is a flow chart for the present control system.

In the control system shown in FIG. 1, a billet B from an extracting mold 2 is extracted by a pair of pinch rolls 2. These pinch rolls 2 are driven by a hydraulic motor 3 in the normal direction or in the reverse direction. The hydraulic pressure supplied to the motor 3 is sensed by a pair of pressure transmitters 4*a*, 4*b*. The operation of the hydraulic motor 3 is controlled by a servo valve 5. The hydraulic pressure of an oil pressure source 6 is transmitted via servo valve 5 to the motor 3 for driving the motor. Since the oil pressure from servo valve 5 drives motor 3 and since pressure transmitters 4*a* and 4*b* sense the input and output pressures on the input and output lines to the motor, the differential between the signals from each of the transmitters 4*a* and 4*b* is indicative of the driving force delivered by the motor to pinch roll 2. A measurement roll 7 is driven in rotation in contact with the billet B. A length sensor 8 issues pulse signals as a function of rotation of the measurement roll 7, while a length counter 9 counts the number of pulses supplied from the length sensor 9.

A pinch roll forcing-back pressure control circuit 10, hereafter referred to as control circuit, compares the actual forcing back length as measured by the length counter 9 and the respective setting values for issuing control command values. A differential amplifier 11 detects the pressure difference on the basis of the signal difference between the signals from the transmitter 4*a* and those from the transmitter 4*b*. The amplifier 12 performs a control arithmetic operation with the output of the control circuit 10 as setting value and with the output of the amplifier 11 as actual or measured values. The amplifier 12 controls the servo valve 5 on the basis of the results of the control arithmetic operation.

The sequential steps of the control process is now explained. In the horizontal continuous casting, an intermittent extraction system is adopted in which the step of extracting the billet B from the mold 1 by the pinch rolls 2 at a preset speed and the step of halting the extraction for allowing the growth of the shell of the extracted billet B are repeated cyclically. In order that the newly formed shell is not ruptured due to contraction of the billet B, a billet forcing-back step is provided in continuation to the halting step for positively assisting contraction of the billet B (see FIG. 1). Thus, upon expiration of a preset halting time interval, the motor 3 is driven in reverse by way of the servo valve 5 for forcing back the billet B towards the mold 1 under the reverse driving force of the pinch rolls 2. The reverse driving torque or force of the hydraulic motor 3 at this time is controlled by operation of the servo valve 5 by the control signals from the control amplifier 12 on the basis of the forcing back pressure setting of the control circuit 10 corresponding to the forced back length referenced to the contraction of the billet B. During this time, the pressure difference obtained at the differential amplifier 11 from the signal difference between the pressure transmitters 4*a*, 4*b* is fed back to the control amplifier. The actual value of the forced back length caused by the forcing-back pressure is counted by the length counter 9 through the measurement roll 7 and the length sensor 8. The resulting signal representative of the actual forced-back length is introduced into the forcing-back pressure control circuit 10 sets a command value of the forced-back length as a function of such factors as roll resistance due to billet size mold profile, molten steel temperature, and the mold resistance, which itself is a function of the steel type, for outputting the corresponding command pushing-back pressure value to the control amplifier 12. The control circuit 10 also receives the actual or measured pushing-back length from the length counter, compares these input length signals with the unusual setting values I, II and high and low setting values, and performs the following operations under the conditions wherein the unusual setting I(LabI)<unusual setting value II (LabII)<high-setting (Lh)<command pushing-back length (Lob)<-low setting (Ll).

(a) Actual pushing-back length Li≧unusual setting (LabI).

In this case, the pushing back operation is in excess and hence the billet B is likely to undergo excess buckling. Hence it is necessary to transiently stop the extraction of the billet B to promote new shell growth.

(b) Unusual setting (LabII)≦actual pushing-back length (Li)<unusual setting (LabI).

In this case, the billet B is likely to undergo some buckling, thus resulting in breakouts. Therefore, the billet extracting speed is decelerated during the next cycle to promote new shell growth.

(c) Actual pushing back length (Li)≧high setting (Lh), the relation occurring repeatedly.

In this case, the pushing-back pressure setting is decremented by a preset value during the next cycle so that the actual pushing-back length is reduced to a value within the range of high setting.

(d) Actual pushing-back length (Li)≦low setting (Ll).

For preventing rupture of the newly formed shell, the pushing-back pressure setting (command or object value) is incremented by a preset value during the next cycle until the setting is reduced to a value within the command or object pushing-back length.

(e) Low setting (Ll)<measured pushing-back length (Li)<high setting(Lh).

The case (e) comprises any other cases not falling under the above described cases (a) to (d). In the case (e), the current pushing back pressure setting is maintained for the next control cycle.

By the above described cases (a) to (e), any error caused by changes in the mold or roll resistance can be reduced to a value within a preset range in such a manner that the measured pushing-back length Li is coincident with the command or object pushing-back length Lob.

We claim:

1. In horizontal continuous casting, a method for controlling the billet pushing-back length, characterized in that the pushing back pressure exerted by pinch rolls is controlled for each extraction cycle in order that the billet being cast is forced back towards the mold a preset length during the cycle time that the billet extraction is transiently stopped.

2. The method according to claim 1 wherein an extraction length measurement unit is included in the billet forcing back control system including pinch rolls, the measured pushing back length is compared with a plurality of commands values, and wherein the pushing back pressure or the extraction speed for the next cycle is corrected on the basis of the comparison results.

3. The method according to claim 2 wherein the billet extraction is transiently stopped for the case Li≧LabI, where Li represents the measured pushing-back length and LabI represents a first unusual setting.

4. The method according to claim 2 wherein the billet extraction speed for the next cycle is reduced for the case LabII≦LI≦LabI, where Li represents the measured pushing-back length and LabI represents a first unusual setting and LabII represents a second unusual setting.

5. The method according to claim 2 wherein the pushing back pressure setting for the pinch rolls for the next cycle is lowered for the case Lh≦Li<LabII, where Li represents the measured pushing-back length and LabII represents a second unusual setting and Lh represents a high setting.

6. The method according to claim 2 wherein the pushing back pressure setting for the pinch rolls is increased for the next cycle for the case $Li \leqq Ll$, where Li represents the measured pushing-back length and Ll represents a low setting.

7. The method according to claim 2 wherein the current pushing back pressure setting for the pinch rolls is maintained during the next cycle for the case $Ll < Li < Lh$, where Li represents the measured pushing-back length, Ll represents a low setting and Lh represents a high setting.

* * * * *